US010789935B2

(12) United States Patent
Bao et al.

(10) Patent No.: US 10,789,935 B2
(45) Date of Patent: Sep. 29, 2020

(54) MECHANICAL TOUCH NOISE CONTROL

(71) Applicant: Cisco Technology, Inc., San Jose, CA (US)

(72) Inventors: Feng Bao, Sunnyvale, CA (US); David William Nolan Robison, Campbell, CA (US); Tor A. Sundsbarm, San Jose, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 16/242,257

(22) Filed: Jan. 8, 2019

(65) Prior Publication Data

US 2020/0219479 A1 Jul. 9, 2020

(51) Int. Cl.
*G10K 11/178* (2006.01)
*H04R 1/10* (2006.01)

(52) U.S. Cl.
CPC .. *G10K 11/17881* (2018.01); *G10K 11/17854* (2018.01); *H04R 1/1083* (2013.01); *G10K 2210/1081* (2013.01); *G10K 2210/1082* (2013.01); *H04R 2460/01* (2013.01)

(58) Field of Classification Search
CPC ..... G10K 11/17881; G10K 11/17854; G10K 2210/1081; G10K 2210/1082; H04R 1/1083; H04R 2460/01
See application file for complete search history.

(56) References Cited

U.S. PATENT DOCUMENTS

| | | | | |
|---|---|---|---|---|
| 8,503,689 | B2 | 8/2013 | Schreuder et al. | |
| 9,226,068 | B2 | 12/2015 | Hendrix et al. | |
| 9,810,925 | B2 | 11/2017 | Fan | |
| 2010/0046770 | A1* | 2/2010 | Chan | H04R 3/005 381/92 |
| 2013/0022214 | A1 | 1/2013 | Dickins et al. | |
| 2018/0012617 | A1 | 1/2018 | Salishev | |
| 2018/0167754 | A1 | 6/2018 | Olsson et al. | |

FOREIGN PATENT DOCUMENTS

WO 2005036924 A1 4/2005

* cited by examiner

*Primary Examiner* — David L Ton
(74) *Attorney, Agent, or Firm* — Edell, Shapiro & Finnan, LLC

(57) ABSTRACT

In one example, a headset obtains a first audio signal including a user audio signal from a first microphone on the headset and a second audio signal including the user audio signal from a second microphone on the headset. The headset derives a first candidate signal from the first audio signal and a second candidate signal from the second audio signal. Based on the first audio signal and the second audio signal, the headset determines that a mechanical touch noise is present in one of the first audio signal and the second audio signal. In response to determining that the mechanical touch noise is present in one of the first audio signal and the second audio signal, the headset selects an output audio signal from a plurality of candidate signals including the first candidate signal and the second candidate signal. Headset provides the output audio signal to a receiver device.

20 Claims, 9 Drawing Sheets

MECHANICAL TOUCH NOISE CONTROL

TECHNICAL FIELD

The present disclosure relates to audio signal control.

BACKGROUND

Local participants in conferencing sessions (e.g., online or web-based meetings) often use headsets with an integrated speaker and/or microphone to communicate with remote meeting participants. The microphone detects speech from the local participant for transmission to the remote meeting participants, but frequently picks up undesired mechanical touch noises along with the speech. Mechanical touch noises can be caused when the local participant touches the headset with their hands. When transmitted with the speech, the mechanical touch noises can be loud and disruptive, preventing the remote meeting participants from understanding the speech. This can be a hindrance to all meeting participants and reduce the effectiveness of the conferencing session.

DESCRIPTION OF EXAMPLE EMBODIMENTS

Overview

In one example, a headset obtains a first audio signal including a user audio signal from a first microphone on the headset and a second audio signal including the user audio signal from a second microphone on the headset. The headset derives a first candidate signal from the first audio signal and a second candidate signal from the second audio signal. Based on the first audio signal and the second audio signal, the headset determines that a mechanical touch noise is present in one of the first audio signal and the second audio signal. In response to determining that the mechanical touch noise is present in one of the first audio signal and the second audio signal, the headset selects an output audio signal from a plurality of candidate signals including the first candidate signal and the second candidate signal. The headset provides the output audio signal to a receiver device.

Example Embodiments

Figure 1:
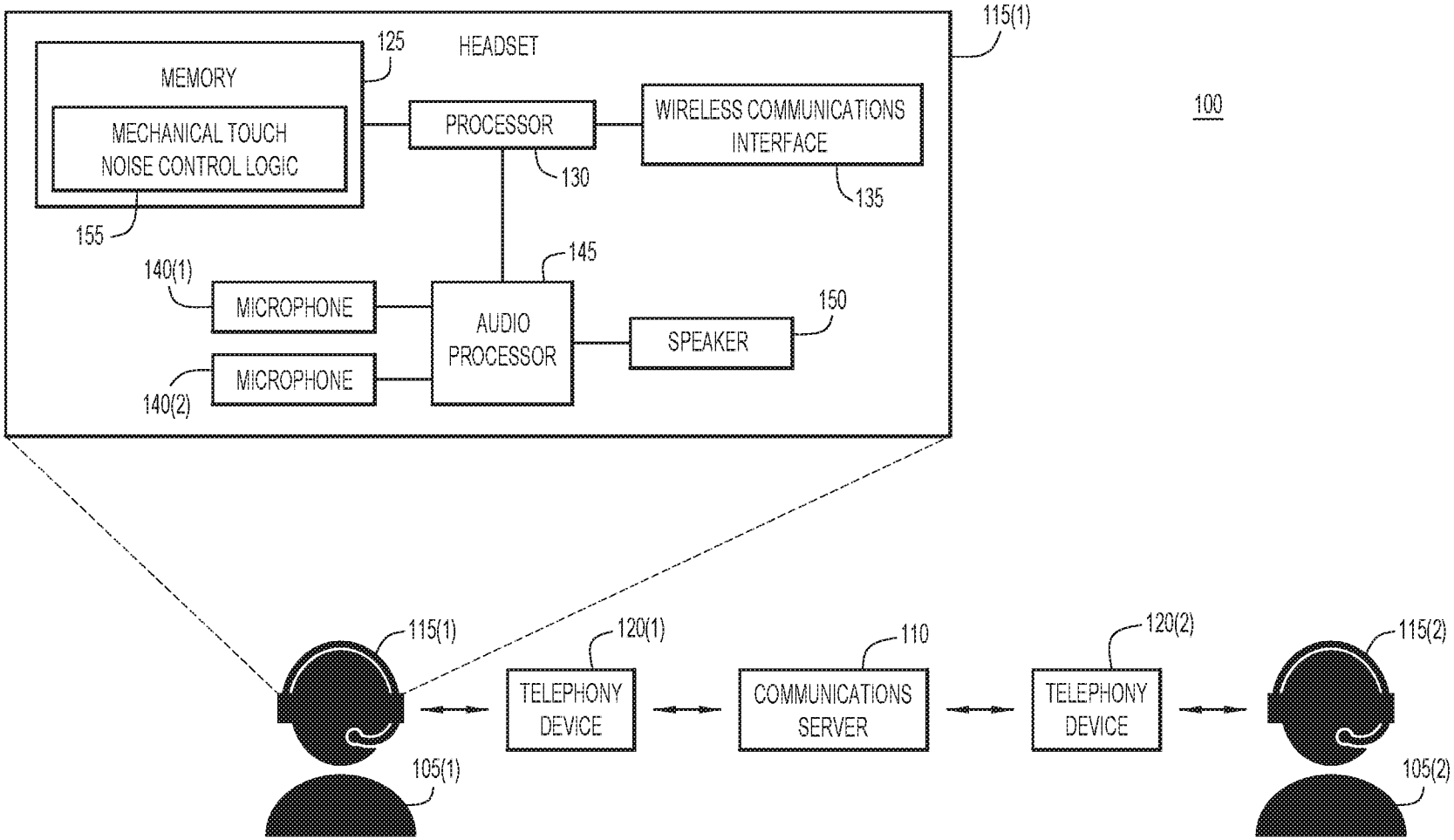
FIG. 1 illustrates a system for controlling a mechanical touch noise, according to an example embodiment.

With reference made to FIG. 1, shown is an example system 100 for controlling an anisotropic background audio signal. In the scenario depicted by FIG. 1, meeting attendees 105(1) and 105(2) are attending an online/remote meeting (e.g., audio call) or conference session. System 100 includes communications server 110, headsets 115(1) and 115(2), and telephony devices 120(1) and 120(2). Communications server 110 is configured to host or otherwise facilitate the meeting. Meeting attendee 105(1) is wearing headset 115(1) and meeting attendee 105(1) is wearing headset 115(2). Headsets 115(1) and 115(2) enable meeting attendees 105(1) and 105(2) to communicate with (e.g., speak and/or listen to) each other in the meeting. Headsets 115(1) and 115(2) may pair to telephony devices 120(1) and 120(2) to enable communication with communications server 110. Examples of telephony devices 120(1) and 120(2) may include desk phones, laptops, conference endpoints, etc.

FIG. 1 includes a high-level block diagram of headset 115(1). Headset 115(1) includes memory 125, processor 130, and wireless communications interface 135. Memory 125 may be read only memory (ROM), random access memory (RAM), magnetic disk storage media devices, optical storage media devices, flash memory devices, electrical, optical, or other physical/tangible memory storage devices. Thus, in general, memory 125 may comprise one or more tangible (non-transitory) computer readable storage media (e.g., a memory device) encoded with software comprising computer executable instructions and when the software is executed (by the processor 130) it is operable to perform the operations described herein.

Wireless communications interface 135 may be configured to operate in accordance with the Bluetooth® short-range wireless communication technology or any other suitable technology now known or hereinafter developed. Wireless communications interface 135 may enable communication with telephony device 120(1). Although wireless communications interface 135 is shown in FIG. 1, it will be appreciated that other communication interfaces may be utilized additionally/alternatively. For example, in another embodiment, headset 115(1) may utilize a wired communication interface to connect to telephony device 120(1).

Headset 115(1) also includes microphones 140(1) and 140(2), audio processor 145, and speaker 150. Audio processor 145 may include one or more integrated circuits that convert audio detected by microphones 140(1) and 140(2) to digital signals that are supplied (e.g., as receive signals) to the processor 130 for wireless transmission via wireless communications interface 135 (e.g., when meeting attendee 105(1) speaks). Thus, processor 130 is coupled to receive signals derived from outputs of microphones 140(1) and 140(2) via audio processor 145. Audio processor 145 may also convert received audio (via wireless communication interface 135) to analog signals to drive speaker 150 (e.g., when meeting attendee 105(2) speaks).

Headset 115(1) may have a boom design or a boomless design. In a boomless design, headset 115(1) includes a first earpiece that houses microphone 140(1) and a second earpiece that houses microphone 140(1). One of the first and second earpieces may be configured for the left ear of meeting attendee 105(1), and the other of the first and second earpieces may be configured for the right ear of meeting attendee 105(1). Microphones 140(1) and 140(2) have approximately equal distances from the mouth of meeting attendee 105(1). In a boom design, headset 115(1) includes a boom that houses microphone 140(1) and an earpiece that houses microphone 140(2). The distances from microphones 140(1) and 140(2) and the mouth of meeting attendee 105(1) in the boomless design may be greater than the distance from microphone 140(1) and the mouth of meeting attendee 105(1) in the boom design. It will be appreciated that microphones 140(1) and 140(2) may be physical microphones or virtual microphones beamformed by an array of physical microphones to improve detection of a user audio signal (e.g., speech from meeting attendee 105(1)

At some point during the meeting, meeting attendee 105(1) may cause a mechanical touch noise in one or more of microphones 140(1) and 140(2). When meeting attendee 105(1) brushes a hand against microphone 140(1), for example, the brush produces a mechanical touch noise which is detected by microphone 140(1). Conventionally, the mechanical touch noise would heavily interfere with the online meeting between meeting attendees 105(1) and 105(2). For example, in some conventional headsets, the mechanical touch noise would drown out any speech from meeting attendee 105(1). Other conventional headsets might be configured to detect the mechanical touch noise and attenuate the outgoing audio signal, but if the mechanical touch noise occurs while meeting attendee 105(1) is talking, the attenuation can effectively mute the user audio signal.

Accordingly, mechanical touch noise control logic 155 is provided to alleviate noise interference due to mechanical touch noise. Briefly, mechanical touch noise control logic 155 causes processor 130 to perform operations to detect and remove mechanical touch noise. Mechanical touch noise control logic 155 enables headset 115(1) to reduce/eliminate mechanical touch noise without muting speech from meeting attendee 105(1). It will be appreciated that at least a portion of mechanical touch noise control logic 155 may be included in devices other than headset 115(1), such as communications server 110.

Microphones 140(1) and 140(2) may be arranged on headset 115(1) such that when meeting attendee causes a mechanical touch noise on one of microphones 140(1) and 140(2), the other of microphones 140(1) and 140(2) is minimally effected. For example, in a boom design, when meeting attendee 105(1) causes a mechanical touch noise in microphone 140(1) by adjusting the boom, microphone 140(2) in one of the earpieces may not pick up the mechanical touch noise. Similarly, in a boomless design, when meeting attendee 105(1) causes a mechanical touch noise in microphone 140(1) by adjusting one earpiece, microphone 140(2) in the other earpiece may not pick up the mechanical touch noise.

Figure 2:
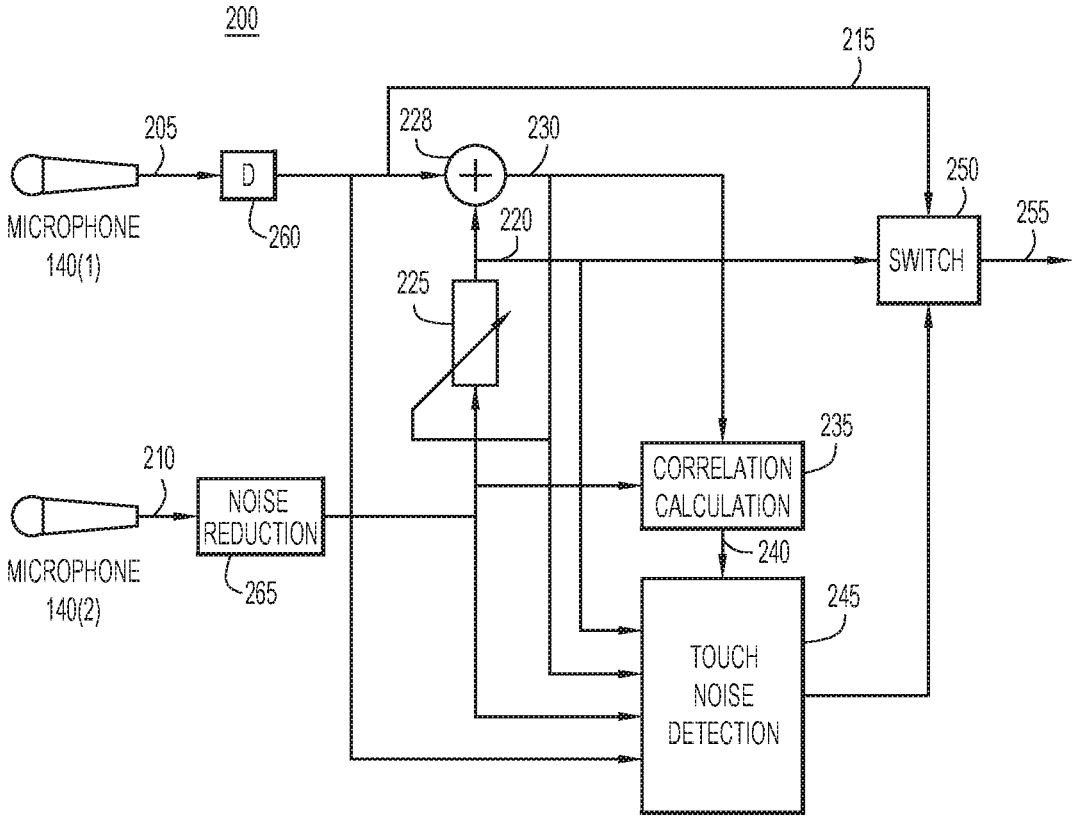
FIG. 2 is a functional signal processing flow diagram illustrating mechanical touch noise control for a headset with a boom, according to an example embodiment.

FIG. 2 is an example functional signal processing flow diagram 200 illustrating mechanical touch noise control for headset 115(1) configured with a boom. Reference is made to FIG. 1 for the purposes of the description of FIG. 2. Headset 115(1) is configured to obtain a first audio signal 205 including the user audio signal from microphone 140(1) and a second audio signal 210 including the user audio signal from a second microphone 140(2). Headset 115(1) derives a first candidate signal 215 from first audio signal 205 and a second candidate signal 220 from second audio signal 210. In this example, first candidate signal 220 is the first audio signal 205, and the second candidate signal 220 is an output of adaptive filter 225. The first audio signal 205 is the primary input for adaptive filter 225, and the second audio signal 210 is the reference input for adaptive filter 225. Adaptive filter 225 may extract signal components from the second audio signal 210 that have a strong correlation with the first audio signal 205 in order to cause the second candidate signal 220 to be closely related to the first candidate signal 215 signal in a spectrum.

Based on the first audio signal 205 and the second audio signal 210, headset 115(1) determines that a mechanical touch noise is present in one of the first audio signal 205 and the second audio signal 210. Adder 228 generates error signal 230 based on the output 220 and the first audio signal 205. Correlation calculation function 235 calculates a correlation value (represented by arrow 240) indicating a level of correlation between error signal 230 and the second audio signal 210. Touch noise detection function 245 determines that the mechanical touch noise is present in one of the first audio signal 205 and the second audio signal 210 based on the first audio signal 205, the second audio signal 210, output 220, error signal 230, and correlation value 240.

In response to determining that the mechanical touch noise is present in one of the first audio signal 205 and the second audio signal 210, switch function 250 may select an output audio signal 255 from a plurality of candidate signals including the first candidate signal 215 and the second candidate signal 220. In one example, the second audio signal 210 should have a sufficient Signal-to-Noise Ratio (SNR) to be selected. Since the second candidate signal 220 is the output of adaptive filter 225, the phase of the second candidate signal 220 should follow that of the first candidate signal 215. Furthermore, switch function 250 may switch from first candidate signal 215 to second candidate signal 220 (e.g., rapidly/immediately) so as to avoid requiring linear interpolation between first candidate signal 215 and second candidate signal 220. It may be desirable to perform the switch when SNR levels of both first candidate signal 215 and second candidate signal 220 are low.

In one example, first candidate signal 215 may be a default audio signal because microphone 140(1) is located in the boom and is therefore expected to detect the user audio signal better than microphone 140(2) detects the user audio signal. Second candidate signal 220 may be considered a backup audio signal. When a mechanical touch noise is detected in first audio signal 205, switch function 250 may select the backup audio signal (second candidate signal 220) as output audio signal 255. After selecting the backup audio signal as the output audio signal 255, headset 115(1) may provide the output audio signal 255 to a receiver device (e.g., telephony device 120(2), which in turn communicates to telephony device 120(2)). Subsequently, touch noise detection function 245 may determine that the mechanical touch noise is no longer present in the first audio signal 205. In response to determining that the mechanical touch noise is no longer present in the first audio signal 205, switch function 250 may select the default audio signal (first candidate signal 215) and provide the default audio signal to the receiver device.

Because microphone 140(1) (boom) is closer to the mouth of meeting attendee 115(1) than microphone 140(2) (earpiece), microphone 140(1) may obtain the user audio signal before microphone 140(2). As such, delay function 260 may delay the first audio signal 205 by a length of time equal to a difference between a time at which the user audio signal reaches microphone 140(1) and a time at which the user audio signal reaches microphone 140(2). Delaying the first audio signal 205 may ensure that adaptive filter 225 converges. The length of time may be the maximum possible time delay between microphone 140(1) and microphone 140(2). The length of time depends on boom length, and may be approximately 0.5 milliseconds. Moreover, because microphone 140(2) is situated on an earpiece, which is further from the mouth of meeting attendee 115(1) than microphone 140(1), second audio signal 210 may have a higher noise floor than audio signal 205. Accordingly, noise reduction function 265 may perform noise reduction on second audio signal 210.

Figure 3:
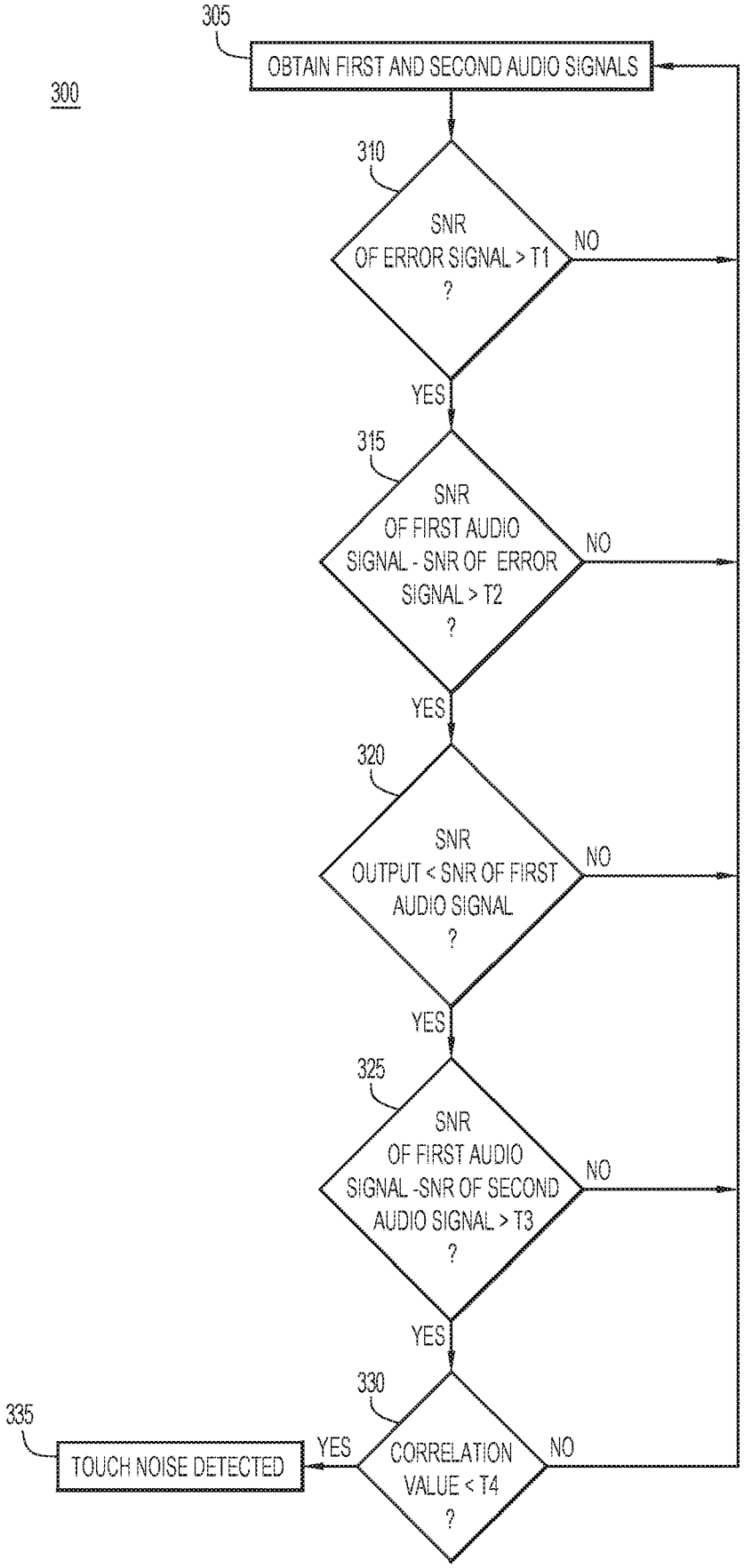
FIG. 3 is a flowchart of a method for determining that a mechanical touch noise is present for a headset with a boom, according to an example embodiment.

FIG. 3 is a flowchart of an example method 300 for determining that a mechanical touch noise at headset 115(1) is present. Reference is made to FIG. 2 for purposes of the description of FIG. 3. Method 300 may be performed by touch noise detection function 245. At 305, first and second audio signals 205 and 210 are obtained. At 310, it is determined whether the SNR of error signal 230 is greater than a first predefined threshold T1. If not, the flow proceeds to 305, and otherwise, the flow proceeds to 315. At 315, it is determined whether a difference between the SNR of the first audio signal 205 and the SNR of error signal 230 is greater than a second predefined threshold T2. If not, the flow proceeds to 305, and otherwise, the flow proceeds to 320. At 320, it is determined whether the SNR of output 220 is less than the SNR of the first audio signal 205. If not, the flow proceeds to 305, and otherwise, the flow proceeds to 325. At 325, it is determined whether a difference in the SNR of the first audio signal 205 and the SNR of the second audio signal 210 is greater than a third predefined threshold T3. If not, the flow proceeds to 305, and otherwise, the flow proceeds to 330. At 330, it is determined whether correlation value 240 is less than a fourth predefined threshold T4. If not, the flow proceeds to 305, and otherwise, a touch noise is detected at 335. The values of T1-T4 may depend on the acoustic design of headset 115(1).

Figure 4:
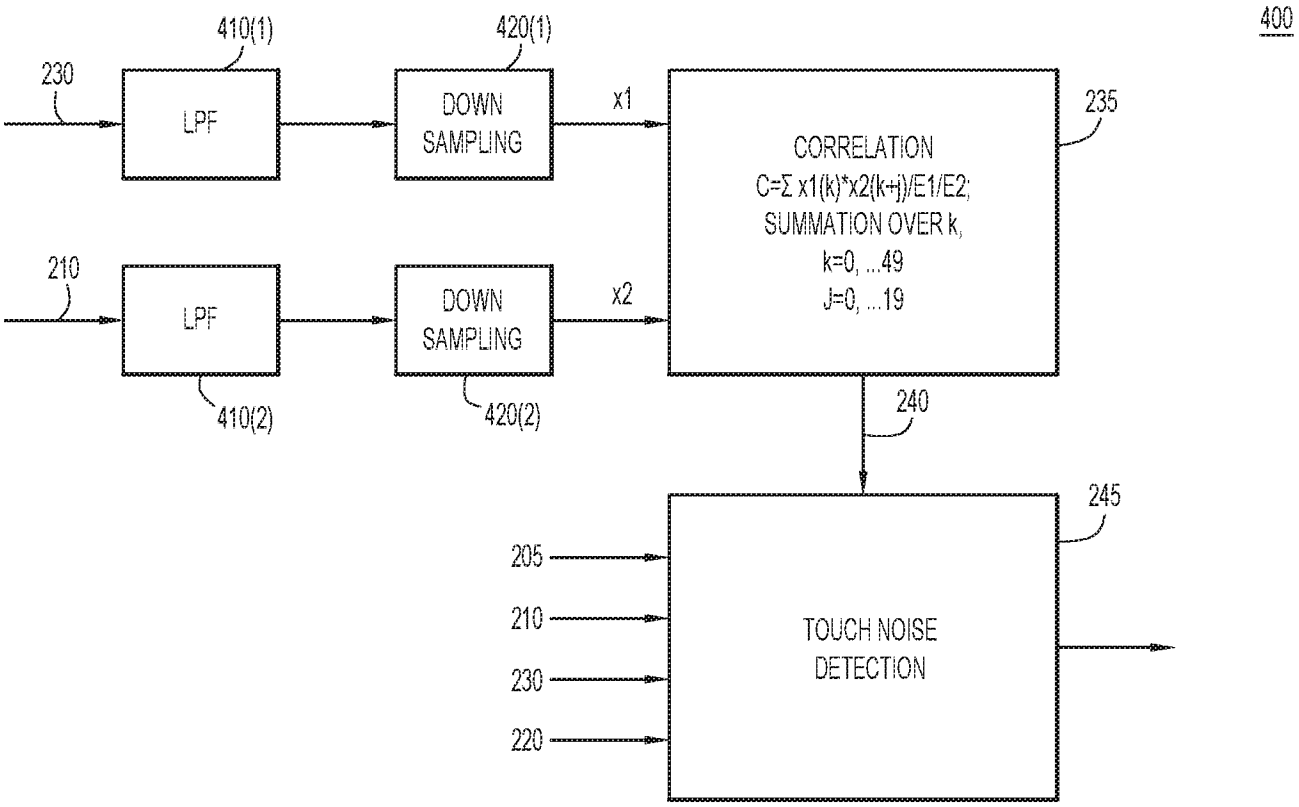
FIG. 4 is a functional signal processing flow diagram illustrating calculation of a correlation value, according to an example embodiment.

FIG. 4 is an example functional signal processing flow diagram 400 illustrating a calculation of correlation value 240. Reference is made to FIG. 2 in connection with the description of FIG. 4. Error signal 230 and second audio signal 210 pass through low pass filters 410(1) and 410(2) and are down-sampled at 420(1) and 420(1). To reduce computation requirements, low pass filters 410(1) and 410(2) may have a cut off frequency below 2 KHz. Error signal 230 and second audio signal 210 may be down sampled to 4 KHz to produce x1 and x2 for the correlation calculation. Correlation may be calculated as $C=\Sigma x1(k)*x2(k+j)/E1/E2$, where summation is over k=0 . . . 39 and J=0 . . . 19, and E1 and E2 are the square roots of the energies of x1 and x2. In particular, $E1=sqrt(\Sigma x1(k)\cdot\hat{}2)$, where k=0 . . . 39, and $E2=sqrt(\Sigma x2(k)\cdot\hat{}2)$, where k=0 . . . 59. Correlation may be performed periodically (e.g., once every 10 milliseconds). SNR estimation of first audio signal 205, second audio signal 210, error signal 230, and output 220 may also be performed periodically (e.g., once every 2-5 milliseconds).

Figure 5A:
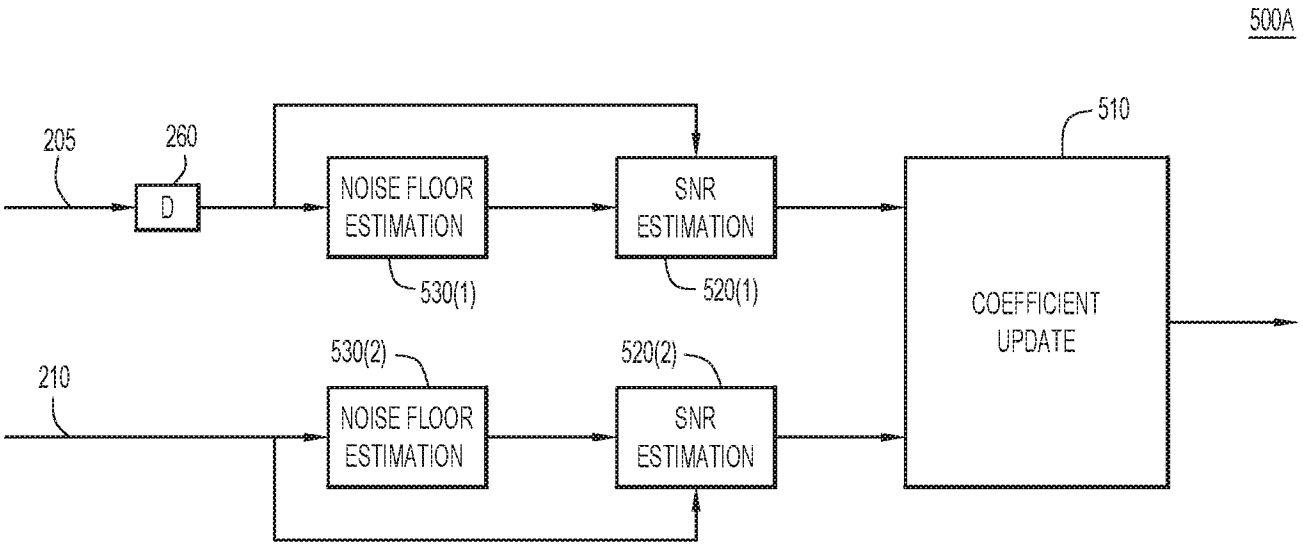
FIG. 5A is a functional signal processing flow diagram illustrating update control of an adaptive filter, according to an example embodiment.

FIG. 5A is an example functional signal processing flow diagram 500A illustrating update control of adaptive filter 225. Reference is made to FIGS. 1 and 2 in connection with the description of FIG. 5A. Coefficient update function 510 controls coefficient updates to adaptive filter 225 based on SNR estimation 520(1) and 520(2) of first and second audio signals 205 and 210. SNR estimation 520(1) and 520(2) may be based on noise floor estimation 530(1) and 530(2) of first and second audio signals 205 and 210. Adaptive filter 225 has a very fast convergence time with a short tail length (e.g., less than 1 millisecond). Since the relative acoustic paths between microphones 140(1) and 140(2) and the mouth of meeting attendee 105(1) is fairly constant, adaptive filter 225 need not update constantly. Noise floor estimation 530(1) and 530(2) may use fast down, slow up low pass filters. SNR estimation 520(1) and 520(2) may be based on the estimated noise floor and current signal strength. Since the mechanical touch noise can occur in milliseconds, the SNR estimation may be performed every 2-5 milliseconds to prevent adaptive filter 225 from incorrectly updating its coefficients.

Figure 5B:
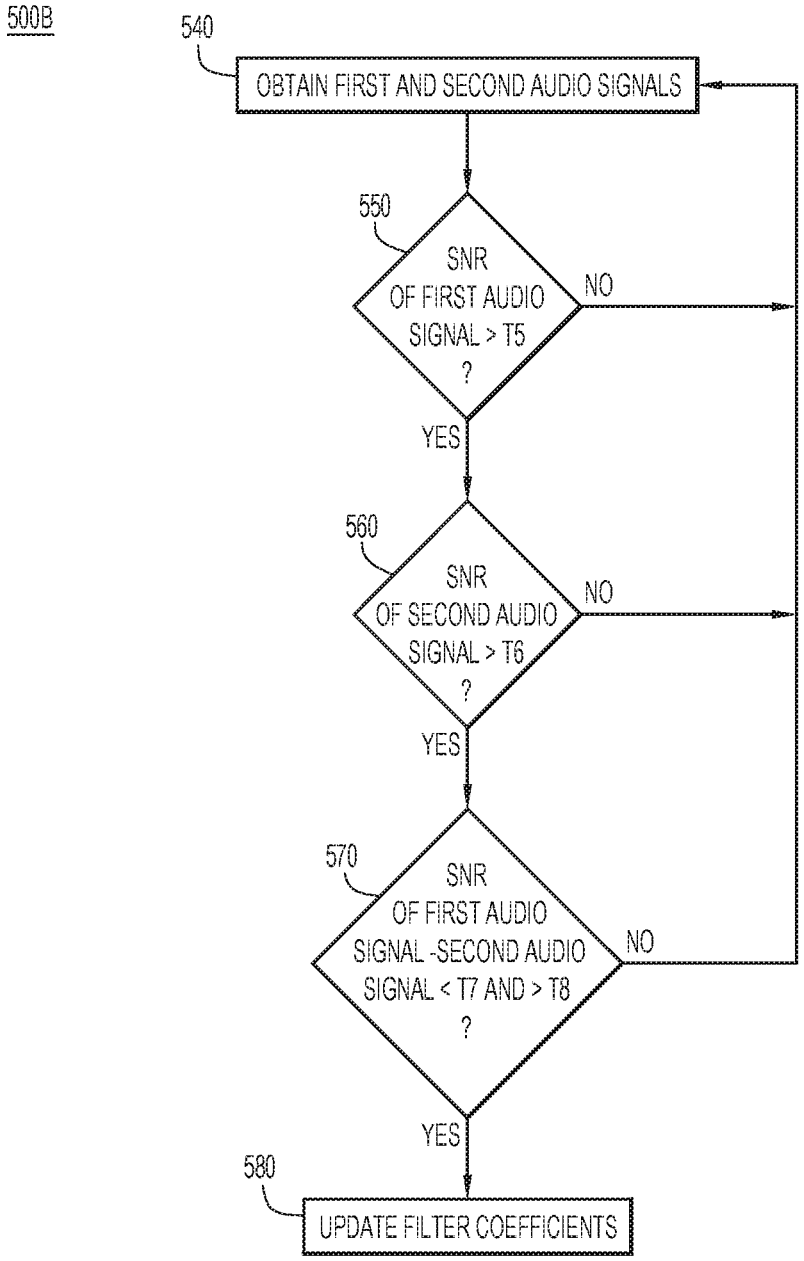
FIG. 5B is a flowchart of another method for controlling an update of an adaptive filter, according to an example embodiment.

FIG. 5B is a flowchart of a method 500B for controlling an update of adaptive filter 225. Reference is made to FIGS. 1 and 2 in connection with the description of FIG. 5B. Method 500B may be performed by coefficient update function 510. At 540, first and second audio signals 205 and 210 are obtained. At 550, it is determined whether the SNR of first audio signal 205 is greater than a fifth predefined threshold T5. If not, the flow proceeds to 540, and otherwise, the flow proceeds to 560. At 560, it is determined whether the SNR of second audio signal 210 is greater than a sixth predefined threshold T6. Because the SNR of second audio signal 210 is generally lower than the SNR of first audio signal 205, T6 may be lower than T5. If it is determined that the SNR of second audio signal 210 is not greater than a sixth predefined threshold T6, the flow proceeds to 540, and otherwise, the flow proceeds to 570. At 570, it is determined whether the difference between the SNR of first audio signal 205 and the SNR of second audio signal 210 is between seventh and eighth thresholds T7 and T8. This prevents coefficient updating when meeting attendee 105(1) is talking while a mechanical touch noise is present. If not, the flow proceeds to 540, and otherwise, the flow proceeds to 580. At 580, coefficient update function 510 updates the coefficients of adaptive filter 225. The values of T5-T8 may depend on the acoustic design of headset 115(1).

Figure 6:
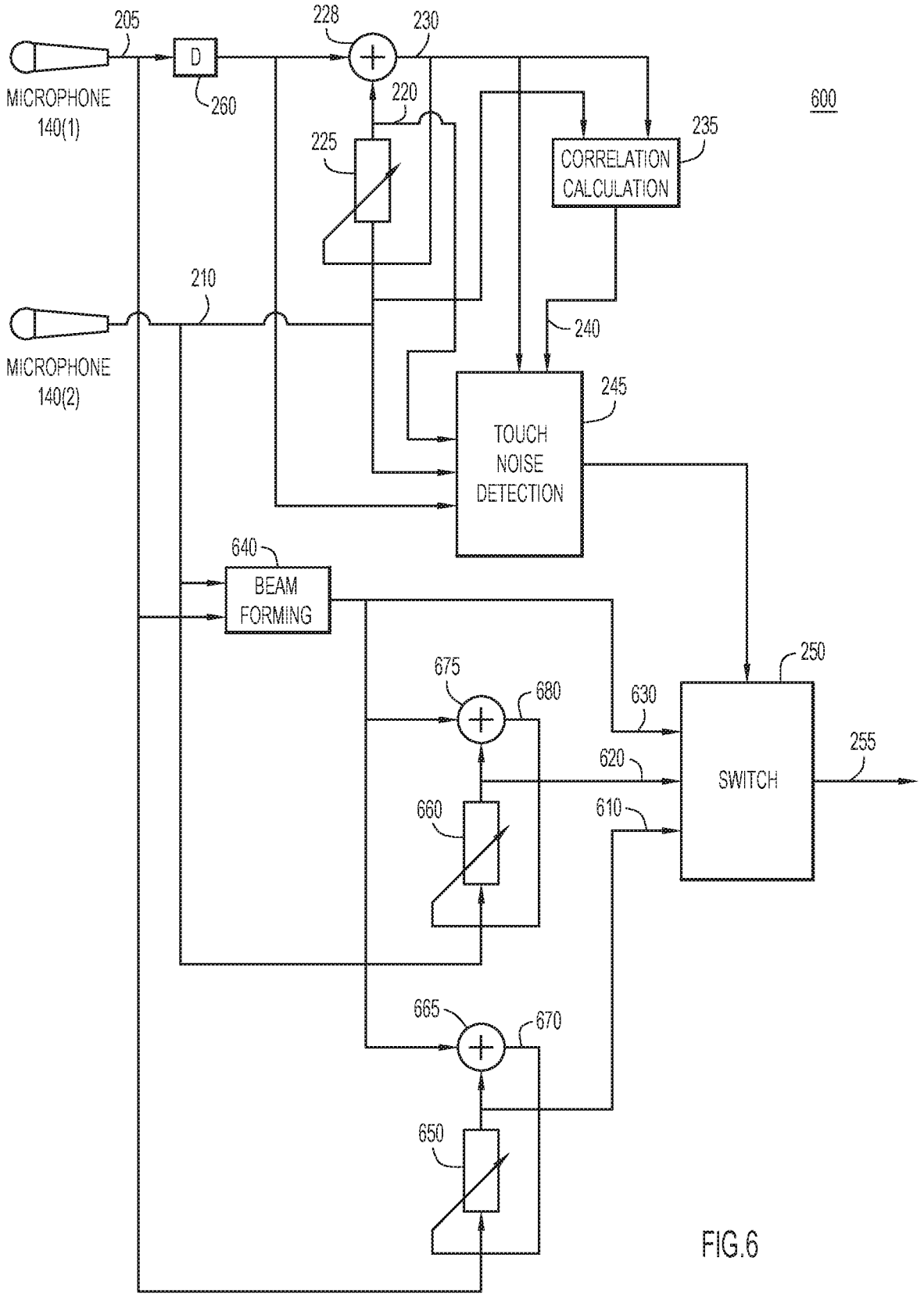
FIG. 6 is a functional signal processing flow diagram illustrating mechanical touch noise control for a headset without a boom, according to an example embodiment.

FIG. 6 is an example functional signal processing flow diagram 600 illustrating mechanical touch noise control for a headset without a boom. Reference is also made to FIGS. 1 and 2 for purposes of the description of FIG. 6. Headset 115(1) is configured to obtain a first audio signal 205 including the user audio signal from microphone 140(1) and a second audio signal 210 including the user audio signal from a second microphone 140(2). Headset 115(1) derives a first candidate signal 610 from first audio signal 205 and a second candidate signal 620 from second audio signal 210. Headset 115(1) combines first audio signal 205 and second audio signal 210 into a beamformed signal 630 using beamforming function 640. Beamformed signal 630 is a third candidate signal 630. While the SNR of beamformed signal 630 may be greater than that of first and second candidate signals 610 and 620, the difference may be small enough (e.g., 3-6 dB) that no independent noise reduction for first and second candidate signals 610 and 620 is necessary.

If user 105(1) does not wear headset 115(1) correctly (e.g., if microphone 140(1) is closer to the mouth of meeting attendee 115(1) than microphone 140(2)), microphone 140(1) (for example) may obtain the user audio signal before microphone 140(2). As such, delay function 260 may delay the first audio signal 205 by a length of time equal to a difference between a time at which the user audio signal reaches microphone 140(1) and a time at which the user audio signal reaches microphone 140(2). Delaying the first audio signal 205 may ensure that adaptive filter 225 converges. The length of time may be, for example, 0.25 milliseconds.

In this example, first candidate signal 610 is output 610 of adaptive filter 650, and the second candidate signal 620 is output 620 of adaptive filter 660. First audio signal 205 is the primary input for adaptive filter 650 and second audio signal 210 is the primary input for adaptive filter 660. Beamformed signal 630 is the reference input for adaptive filters 650 and 660. Adder 665 generates error signal 670 based on output 610 and beamformed signal 630. Adder 675 generates error signal 680 of adaptive filter 660 based on output 620 and beamformed signal 630. Adaptive filters 225, 650, and 660 may be controlled by the same coefficient update function. Adaptive filter coefficients may be updated in a similar manner as described in connection with FIGS. 5A and 5B.

Based on the first audio signal 205 and the second audio signal 210, headset 115(1) determines that a mechanical touch noise is present in one of the first audio signal 205 and the second audio signal 210. Adaptive filter 225 generates error signal 230 based on the output 220 and the first audio signal 205. Correlation calculation function 235 calculates correlation value 240 indicating a level of correlation between error signal 230 and the second audio signal 210. Correlation calculation function 235 may calculate a correlation value 240 using any suitable calculation, such as similar to that described in connection with FIG. 4.

Touch noise detection function 245 determines that the mechanical touch noise is present in one of the first audio signal 205 and the second audio signal 210 based on the first audio signal 205, the second audio signal 210, output 225, error signal 230, and correlation value 240. In response to determining that the mechanical touch noise is present in one of the first audio signal 205 and the second audio signal 210, switch function 250 may select output audio signal 255 from candidate signals 610, 620, and 630. Headset 115(1) may provide the output audio signal 255 to a receiver device (e.g., headset 115(2)).

In one example, beamformed signal 630 may be a default audio signal because beamformed signal 630 is expected to improve user audio signal detection compared to first and second candidate signals 610 and 620. First and second candidate signals 610 and 620 may be backup audio signals. When a mechanical touch noise is detected in beamformed signal 630, switch function 250 may select the backup audio signal (e.g., first candidate signal 620) as output audio signal 255. After selecting the backup audio signal as the output audio signal 255, headset 115(1) may provide the output audio signal 255 to a receiver device (e.g., headset 115(2)). Subsequently, touch noise detection function 245 may determine that the mechanical touch noise is no longer present in beamformed signal 630. In response to determining that the mechanical touch noise is no longer present in beamformed signal 630, switch function 250 may select the default audio signal (beamformed signal 630) and provide the default audio signal to the receiver device.

Figure 7:
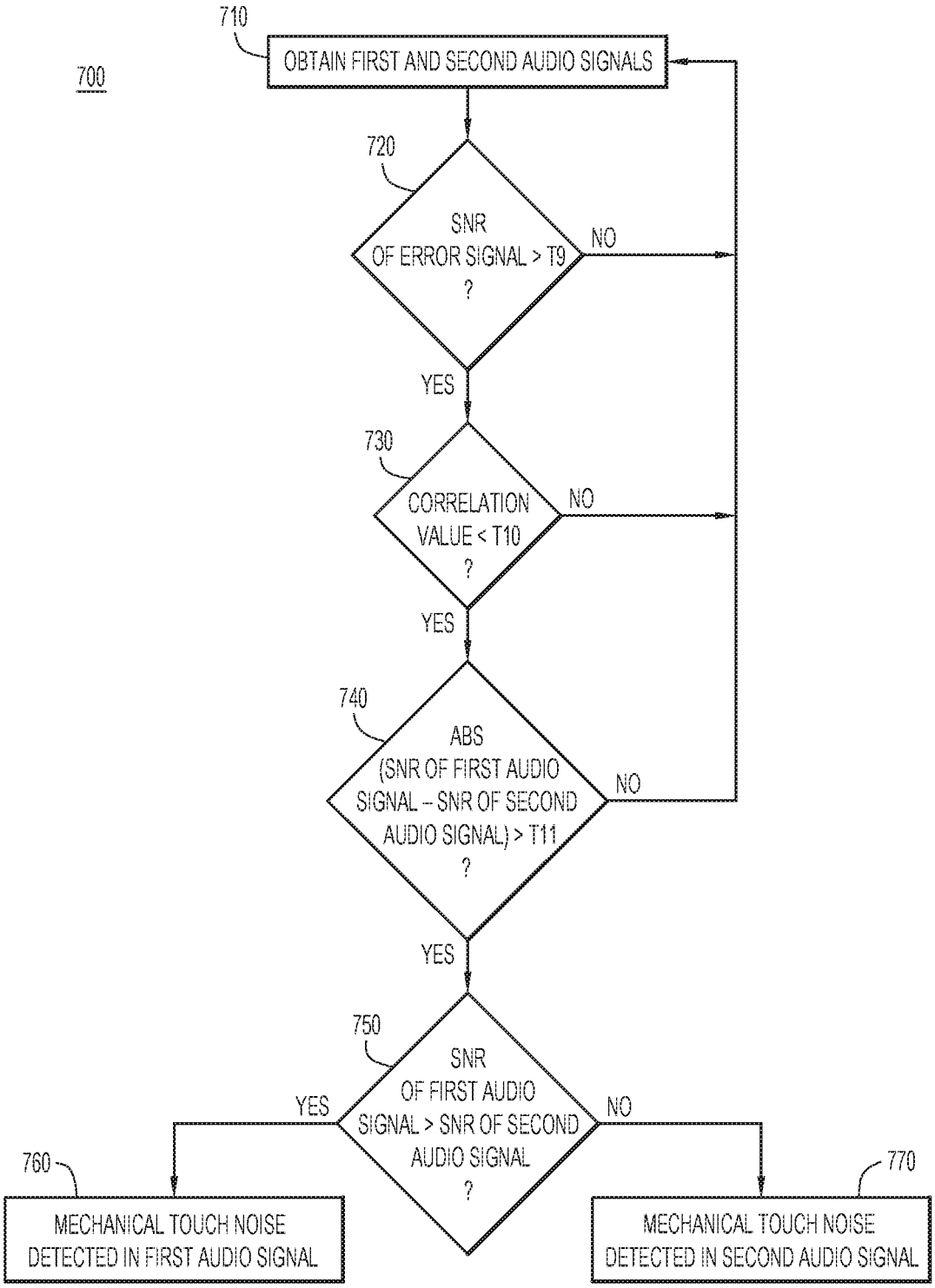
FIG. 7 is a flowchart of a method for determining that a mechanical touch noise is present for a headset without a boom, according to an example embodiment.

FIG. 7 is a flowchart of an example method 700 for determining that a mechanical touch noise is present for a headset without a boom. Reference is also made to FIG. 2 for purposes of the description of FIG. 7. Method 700 may be performed by touch noise detection function 245. At 710, first and second audio signals 205 and 210 are obtained. At 720, it is determined whether the SNR of error signal 230 is greater than a ninth predefined threshold T9. If not, the flow proceeds to 710, and otherwise, the flow proceeds to 730. At 730, it is determined whether correlation value 240 is greater than a tenth predefined threshold T10. If not, the flow proceeds to 710, and otherwise, the flow proceeds to 740. At 740, it is determined whether the absolute value of the difference between the SNR of first audio signal 205 and the SNR of second audio signal 210 is greater than an eleventh predefined threshold T11. If not, the flow proceeds to 710, and otherwise, the flow proceeds to 750. At 750, it is determined whether the SNR of first audio signal 205 is greater than the SNR of second audio signal 210. If so, the mechanical touch noise is detected in first audio signal 205 at 760. Otherwise, the mechanical touch noise is detected in second audio signal 210 at 770.

Figure 8:
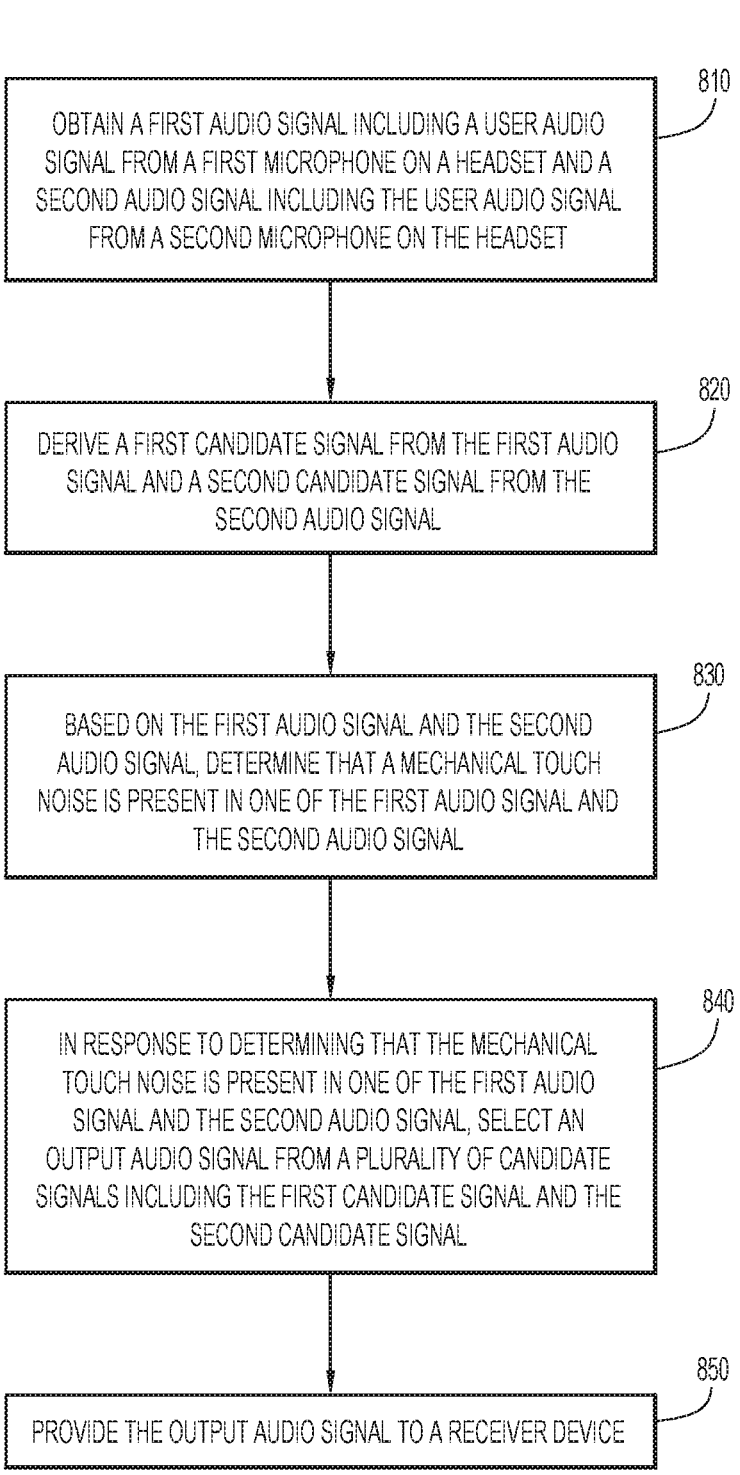
FIG. 8 is a flowchart of a generalized method for controlling mechanical touch noise, according to an example embodiment.

FIG. 8 is a flowchart of an example generalized method 800 for controlling mechanical touch noise. Reference is made to FIG. 1 for purposes of the description of FIG. 8. Method 800 may be performed by headset 115(1). At 810, headset 115(1) obtains a first audio signal including a user audio signal from a first microphone on a headset and a second audio signal including the user audio signal from a second microphone on the headset. At 820, headset 115(1) derives a first candidate signal from the first audio signal and a second candidate signal from the second audio signal. At 830, based on the first audio signal and the second audio signal, headset 115(1) determines that a mechanical touch noise is present in one of the first audio signal and the second audio signal. At 840, in response to determining that the mechanical touch noise is present in one of the first audio signal and the second audio signal, headset 115(1) selects an output audio signal from a plurality of candidate signals including the first candidate signal and the second candidate signal. At 850, headset 115(1) provides the output audio signal to a receiver device.

Described herein is a method to detect and remove a mechanical touching noise from an outgoing audio signal with multiple microphones implemented in a headset. The method may be used for headsets with or without a boom. Detection may be performed using an adaptive filter implemented between the microphones and calculation of signal correlations. After detection, a microphone signal without the mechanical touch noise may be used as the output audio signal.

In one form, an apparatus is provided. The apparatus comprises: a first microphone; a second microphone; and a processor coupled to receive signals derived from outputs of the first microphone and the second microphone, wherein the processor is configured to: obtain a first audio signal including a user audio signal from the first microphone on a headset and a second audio signal including the user audio signal from the second microphone on the headset; derive a first candidate signal from the first audio signal and a second candidate signal from the second audio signal; based on the first audio signal and the second audio signal, determine that a mechanical touch noise is present in one of the first audio signal and the second audio signal; in response to determining that the mechanical touch noise is present in one of the first audio signal and the second audio signal, select an output audio signal from a plurality of candidate signals including the first candidate signal and the second candidate signal; and provide the output audio signal to a receiver device.

In a one example, the processor is configured to determine that the mechanical touch noise is present in one of the first audio signal and the second audio signal by: adaptively filtering the second audio signal using a first adaptive filter to generate an output of the first adaptive filter; generating an error signal of the first adaptive filter based on the output of the first adaptive filter and the first audio signal; calculating a correlation value indicating a level of correlation between the error signal and the second audio signal, and determining that the mechanical touch noise is present in one of the first audio signal and the second audio signal based on the first audio signal, the second audio signal, the output of the first adaptive filter, the error signal, and the correlation value.

In one example, the apparatus further comprises a boom that houses the first microphone and an earpiece that houses the second microphone. In a further example, the processor is configured to determine that the mechanical touch noise is present in one of the first audio signal and the second audio signal based on the first audio signal, the second audio signal, the output of the first adaptive filter, the error signal, and the correlation value by: determining that a signal-to-noise ratio of the error signal is greater than a first predefined threshold; determining that a difference between a signal-to-noise ratio of the first audio signal and the signal-to-noise ratio of the error signal is greater than a second predefined threshold; determining that a signal-to-noise ratio of the output of the first adaptive filter is less than the signal-to-noise ratio of the first audio signal; determining that a difference between the signal-to-noise ratio of the first audio signal and a signal-to-noise ratio of the second audio signal is greater than a third predefined threshold; and determining that the correlation value is less than a fourth predefined threshold. In another further example, the first candidate signal is the first audio signal and the second candidate signal is the output of the first adaptive filter.

In yet another further example, the first candidate signal is the first audio signal and the second candidate signal is the output of the first adaptive filter. In still another further example, the processor is further configured to: update coefficients of the first adaptive filter when a signal-to-noise ratio of the first audio signal is greater than a first predefined threshold, when a signal-to-noise ratio of the second audio signal is greater than a second predefined threshold, and when a difference between the signal-to-noise ratio of the first audio signal and the signal-to-noise ratio of the third audio signal is between a second predefined threshold and a third predefined threshold. In yet another further example, the processor is further configured to: perform noise reduction on the second audio signal.

In another example, the apparatus further comprises a first earpiece that houses the first microphone and a second earpiece that houses the second microphone. In a further example, the processor is configured to determine that the mechanical touch noise is present in one of the first audio signal and the second audio signal based on the first audio signal, the second audio signal, the output of the first adaptive filter, the error signal, and the correlation value by: determining that a signal-to-noise ratio of the error signal is greater than a first predefined threshold; determining that the correlation value is less than a second predefined threshold; determining that an absolute value of a difference between a signal-to-noise ratio of the first audio signal and a signal-to-noise ratio of the second audio signal is greater than a third predefined threshold; and determining that the signal-to-noise ratio of the first audio signal is greater than the signal-to-noise ratio of the second audio signal.

In yet another further example, the processor is further configured to: adaptively filter the first audio signal using a second adaptive filter to generate an output of the second adaptive filter, wherein the output of the second adaptive filter is the first candidate signal; and adaptively filter the second audio signal using a third adaptive filter to generate an output of the third adaptive filter, wherein the output of the third adaptive filter is the second candidate signal. In one example, the processor is further configured to: combine the first audio signal and the second audio signal into a beamformed signal, wherein the beamformed signal is a third candidate signal in the plurality of candidate signals; generate an error signal of the second adaptive filter based on the output of the second adaptive filter and the beamformed signal; and generate an error signal of the third adaptive filter based on the output of the third adaptive filter and the beamformed signal.

In another form, a method is provided. The method comprises: obtaining a first audio signal including a user audio signal from a first microphone on a headset and a second audio signal including the user audio signal from a second microphone on the headset; deriving a first candidate signal from the first audio signal and a second candidate signal from the second audio signal; based on the first audio signal and the second audio signal, determining that a mechanical touch noise is present in one of the first audio signal and the second audio signal; in response to determining that the mechanical touch noise is present in one of the first audio signal and the second audio signal, selecting an output audio signal from a plurality of candidate signals including the first candidate signal and the second candidate signal; and providing the output audio signal to a receiver device.

In another form, one or more non-transitory computer readable storage media are provided. The non-transitory computer readable storage media are encoded with instructions that, when executed by a processor, cause the processor to: obtain a first audio signal including a user audio signal from a first microphone on a headset and a second audio signal including the user audio signal from a second microphone on the headset; derive a first candidate signal from the first audio signal and a second candidate signal from the second audio signal; based on the first audio signal and the second audio signal, determine that a mechanical touch noise is present in one of the first audio signal and the second audio signal; in response to determining that the mechanical touch noise is present in one of the first audio signal and the second audio signal, select an output audio signal from a plurality of candidate signals including the first candidate signal and the second candidate signal; and provide the output audio signal to a receiver device.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. An apparatus comprising:

a first microphone;

a second microphone; and a processor coupled to receive signals derived from outputs of the first microphone and the second microphone, wherein the processor is configured to:

obtain a first audio signal including a user audio signal from the first microphone on a headset and a second audio signal including the user audio signal from the second microphone on the headset;

derive a first candidate signal from the first audio signal and a second candidate signal from the second audio signal;

adaptively filter the second audio signal using a first adaptive filter to generate an output of the first adaptive filter;

generate an error signal of the first adaptive filter based on the output of the first adaptive filter and the first audio signal;

determine that a mechanical touch noise is present in one of the first audio signal and the second audio signal based on the first audio signal, the second audio signal, the output of the first adaptive filter, and the error signal;

in response to determining that the mechanical touch noise is present in the one of the first audio signal and the second audio signal, select an output audio signal from a plurality of candidate signals including the first candidate signal and the second candidate signal; and provide the output audio signal to a receiver device.

2. The apparatus of claim 1, wherein the processor is further configured to:

calculate a correlation value indicating a level of correlation between the error signal and the second audio signal; and determine that the mechanical touch noise is present in the one of the first audio signal and the second audio signal based further on the correlation value.

3. The apparatus of claim 2, further comprising a boom that houses the first microphone and an earpiece that houses the second microphone.

4. The apparatus of claim 3, wherein the processor is configured to determine that the mechanical touch noise is present in the one of the first audio signal and the second audio signal based on the first audio signal, the second audio signal, the output of the first adaptive filter, the error signal, and the correlation value by:

determining that a signal-to-noise ratio of the error signal is greater than a first predefined threshold;

determining that a difference between a signal-to-noise ratio of the first audio signal and the signal-to-noise ratio of the error signal is greater than a second predefined threshold;

determining that a signal-to-noise ratio of the output of the first adaptive filter is less than the signal-to-noise ratio of the first audio signal;

determining that a difference between the signal-to-noise ratio of the first audio signal and a signal-to-noise ratio of the second audio signal is greater than a third predefined threshold; and determining that the correlation value is less than a fourth predefined threshold.

5. The apparatus of claim 3, wherein the first candidate signal is the first audio signal and the second candidate signal is the output of the first adaptive filter.

6. The apparatus of claim 3, wherein the processor is further configured to:

update coefficients of the first adaptive filter when a signal-to-noise ratio of the first audio signal is greater than a first predefined threshold, when a signal-to-noise ratio of the second audio signal is greater than a second predefined threshold, and when a difference between the signal-to-noise ratio of the first audio signal and the signal-to-noise ratio of the second audio signal is between a third predefined threshold and a fourth predefined threshold.

7. The apparatus of claim 3, wherein the processor is further configured to:

perform noise reduction on the second audio signal.

8. The apparatus of claim 2, further comprising a first earpiece that houses the first microphone and a second earpiece that houses the second microphone.

9. The apparatus of claim 8, wherein the processor is configured to determine that the mechanical touch noise is present in the one of the first audio signal and the second audio signal based on the first audio signal, the second audio signal, the output of the first adaptive filter, the error signal, and the correlation value by:

determining that a signal-to-noise ratio of the error signal is greater than a first predefined threshold;

determining that the correlation value is less than a second predefined threshold;

determining that an absolute value of a difference between a signal-to-noise ratio of the first audio signal and a signal-to-noise ratio of the second audio signal is greater than a third predefined threshold; and determining that the signal-to-noise ratio of the first audio signal is greater than the signal-to-noise ratio of the second audio signal.

10. The apparatus of claim 8, wherein the processor is further configured to:

adaptively filter the first audio signal using a second adaptive filter to generate an output of the second adaptive filter, wherein the output of the second adaptive filter is the first candidate signal; and adaptively filter the second audio signal using a third adaptive filter to generate an output of the third adaptive filter, wherein the output of the third adaptive filter is the second candidate signal.

11. The apparatus of claim 10, wherein the processor is further configured to:

combine the first audio signal and the second audio signal into a beamformed signal, wherein the beamformed signal is a third candidate signal in the plurality of candidate signals;

generate an error signal of the second adaptive filter based on the output of the second adaptive filter and the beamformed signal; and generate an error signal of the third adaptive filter based on the output of the third adaptive filter and the beamformed signal.

12. The apparatus of claim 1, wherein the processor is further configured to:

delay the first audio signal by a length of time equal to a difference between a time at which the user audio signal reaches one of the first microphone and the second microphone and a time at which the user audio signal reaches the other of the first microphone and the second microphone.

13. The apparatus of claim 1, wherein the output audio signal is a backup audio signal to a default audio signal, and wherein the processor is further configured to:

determine that the mechanical touch noise is no longer present in the one of the first audio signal and the second audio signal;

in response to determining that the mechanical touch noise is no longer present in the one of the first audio signal and the second audio signal, select the default audio signal from the plurality of candidate signals; and provide the default audio signal to the receiver device.

14. A method comprising:

obtaining a first audio signal including a user audio signal from a first microphone on a headset and a second audio signal including the user audio signal from a second microphone on the headset;

deriving a first candidate signal from the first audio signal and a second candidate signal from the second audio signal;

adaptively filtering the second audio signal using a first adaptive filter to generate an output of the first adaptive filter;

generating an error signal of the first adaptive filter based on the output of the first adaptive filter and the first audio signal;

determining that a mechanical touch noise is present in one of the first audio signal and the second audio signal based on the first audio signal, the second audio signal, the output of the first adaptive filter, and the error signal;

in response to determining that the mechanical touch noise is present in the one of the first audio signal and the second audio signal, selecting an output audio signal from a plurality of candidate signals including the first candidate signal and the second candidate signal; and providing the output audio signal to a receiver device.

15. The method of claim 14, further comprising calculating a correlation value indicating a level of correlation between the error signal and the second audio signal; and determining that the mechanical touch noise is present in the one of the first audio signal and the second audio signal based further on the correlation value.

16. The method of claim 14, further comprising:

delaying the first audio signal by a length of time equal to a difference between a time at which the user audio signal reaches one of the first microphone and the second microphone and a time at which the user audio signal reaches the other of the first microphone and the second microphone.

17. The method of claim 14, wherein the output audio signal is a backup audio signal to a default audio signal, the method further comprising:

determining that the mechanical touch noise is no longer present in the one of the first audio signal and the second audio signal;

in response to determining that the mechanical touch noise is no longer present in the one of the first audio signal and the second audio signal, selecting the default audio signal from the plurality of candidate signals; and providing the default audio signal to the receiver device.

18. One or more non-transitory computer readable storage media encoded with instructions that, when executed by a processor, cause the processor to:

obtain a first audio signal including a user audio signal from a first microphone on a headset and a second audio signal including the user audio signal from a second microphone on the headset;

derive a first candidate signal from the first audio signal and a second candidate signal from the second audio signal;

adaptively filter the second audio signal using a first adaptive filter to generate an output of the first adaptive filter;

generate an error signal of the first adaptive filter based on the output of the first adaptive filter and the first audio signal;

determine that a mechanical touch noise is present in one of the first audio signal and the second audio signal based on the first audio signal, the second audio signal, the output of the first adaptive filter, and the error signal;

in response to determining that the mechanical touch noise is present in the one of the first audio signal and the second audio signal, select an output audio signal from a plurality of candidate signals including the first candidate signal and the second candidate signal; and provide the output audio signal to a receiver device.

19. The one or more non-transitory computer readable storage media of claim 18, wherein the instructions further cause the processor to:

calculate a correlation value indicating a level of correlation between the error signal and the second audio signal; and determine that the mechanical touch noise is present in the one of the first audio signal and the second audio signal based further on the correlation value.

20. The one or more non-transitory computer readable storage media of claim 18, wherein the instructions further cause the processor to:

delay the first audio signal by a length of time equal to a difference between a time at which the user audio signal reaches one of the first microphone and the second microphone and a time at which the user audio signal reaches the other of the first microphone and the second microphone.

* * * * *